US005531330A

United States Patent [19]

Nagaraj et al.

[11] Patent Number: 5,531,330

[45] Date of Patent: Jul. 2, 1996

[54] METHOD OF DEPRESSING NON-SULFIDE SILICATE GANGUE MINERALS

[75] Inventors: D. R. Nagaraj, Stamford; Samuel S. Wang, Cheshire, both of Conn.

[73] Assignee: Cytec Technology Corp., Wilmington, Del.

[21] Appl. No.: 474,805

[22] Filed: Jun. 7, 1995

[51] Int. Cl.[6] ..... B03D 1/016; B03D 1/06

[52] U.S. Cl. ..... 209/167; 252/61

[58] Field of Search ..... 209/167, 166; 252/61

[56] References Cited

U.S. PATENT DOCUMENTS

| | | |
|---|---|---|
| 2,740,522 | 4/1956 | Aimone . |
| 3,929,629 | 12/1975 | Griffith . |
| 4,339,331 | 7/1982 | Lim . |
| 4,360,425 | 11/1982 | Lim . |
| 4,719,009 | 1/1988 | Furey . |
| 4,720,339 | 1/1988 | Nagaraj . |
| 4,744,893 | 5/1988 | Rothenberg . |
| 4,853,114 | 8/1989 | Lewis . |
| 4,866,150 | 9/1989 | Lipp . |
| 5,030,340 | 7/1991 | Panzer . |
| 5,057,209 | 10/1991 | Klimpel . |

*Primary Examiner*—Thomas M. Lithgow
*Attorney, Agent, or Firm*—Frank M. Van Riet

[57] ABSTRACT

A method for the depression of non-sulfide, silicate gangue minerals is provided wherein the depressant is a polymeric material comprising recurring units of the formula:

$$+X\frac{}{x}\quad +Y\frac{}{y}\quad +Z\frac{}{z}$$

wherein X is the polymerization residue of an acrylamide or mixture of acrylamides, Y is an hydroxy group containing polymer unit, Z is an anionic group containing polymer unit, x represents a residual mole fraction of at least about 35%, y represents a residual mole fraction of from about 1 to 50% and z represents a residual mole fraction of from about 0 to about 50%.

17 Claims, No Drawings

METHOD OF DEPRESSING NON-SULFIDE SILICATE GANGUE MINERALS

BACKGROUND OF INVENTION

The present invention relates to froth flotation processes for recovery of value sulfide minerals from base metal sulfide ores. More particularly, it relates to a method for the depression of non-sulfide silicate gangue minerals in the beneficiation of value sulfide minerals by froth flotation procedures.

Certain theory and practice states that the success of a sulfide flotation process depends to a groat degree on reagents called collectors that impart selective hydrophobicity to the mineral value which has to be separated from other minerals.

Certain other important reagents, such as the modifiers, are also responsible for the successful flotation separation of the value sulfide and other minerals. Modifiers include, but are not necessarily limited to, all reagents whose principal function is neither collecting nor frothing, but usually one of modifying the surface of the mineral so that it does not float.

In addition to attempts at making sulfide collectors more selective for value sulfide minerals, other approaches to the problem of improving the flotation separation of value sulfide minerals have included the use of modifiers, more particularly depressants, to depress the non-sulfide gangue minerals so that they do not float along with sulfides thereby reducing the levels of non-sulfide gangue minerals reporting to the concentrates. A depressant is a modifier reagent which acts selectively on certain unwanted minerals and prevents or inhibits their flotation.

In sulfide value mineral flotation, certain non-sulfide silicate gangue minerals present a unique problem in that they exhibit natural floatability, i.e. they float independent of the sulfide value mineral collectors used. Even if very selective sulfide value mineral collectors are used, these silicate minerals report to the sulfide concentrates. Talc and pyrophyllite, both belonging to the class of magnesium silicates, are particularly troublesome in that they are naturally highly hydrophobic. Other magnesium silicate minerals belonging to the classes of oilvines, pyroxenes, and serpentine exhibit various degrees of floatability that seems to vary from one ore deposit to the other. The presence of these unwanted minerals in sulfide value mineral concentrates causes many problems i.e. a) they increase the mass of the concentrates thus adding to the cost of handling and transportation of the concentrate, b) they compete for space in the froth phase during the flotation stage thereby reducing the overall sulfide value mineral recovery, and c) they dilute the sulfide concentrate with respect to the value sulfide mineral content which makes them less suitable, and in some cases unsuitable, for the smelting thereof because they interfere with the smelting operation.

The depressants commonly used in sulfide flotation include such materials as inorganic salts (NaCN, NaHS, SO2, sodium metabisulfite etc.) and small amounts of organic compounds such as sodium thioglycolate, mercaptoethanol etc. These depressants are known to be capable of depressing sulfide minerals but are not known to be depressants for non-sulfide minerals, just as known value sulfide collectors are usually not good collectors for non-sulfide value minerals. Sulfide and non-sulfide minerals have vastly different bulk and surface chemical properties. Their response to various chemicals is also vastly different. At present, certain polysaccharides such as guar gum and carboxy methyl cellulose, are used to depress non-sulfide silicate gangue minerals during sulfide flotation. Their performance, however, is very variable and on some ores they show unacceptable depressant activity and the effective dosage per ton of ore is usually very high (as much as 1 to 10 lbs/ton). Their depressant activity is also influenced by their source and is not consistent from batch to batch. Furthermore, these polysaccharides are also valuable sources of food i.e. their use as depressants reduces their usage as food and, storage thereof presents particular problems with regard to their attractiveness as food for vermin. Lastly, they are not readily miscible or soluble in water and even where water solutions thereof can be made, they are not stable. U.S. Pat. No. 4,902,764 (Rothenberg et al.) describes the use of polyacrylamide-based synthetic copolymers and terpolymers for use as sulfide mineral depressants in the recovery of value sulfide minerals. U.S. Pat. No. 4,720,339 (Nagaraj et al) describes the use of polyacrylamide-based synthetic copolymers and terpolymers as depressants for silicious gangue minerals in the flotation beneficiation of non-sulfide value minerals, but not as depressants in the benefication of sulfide value minerals. The '339 patent teaches that such polymers are effective for silica depression during phosphate flotation which also in the flotation stage uses fatty acids and non-sulfide collectors. The patentees do not teach that such polymers are effective depressants for non-sulfide silicate gangue minerals in the recovery of value sulfide minerals. In fact, such depressants do not exhibit adequate depressant activity for non-sulfide silicate minerals during the beneficiation of sulfide value minerals. U.S. Pat. No. 4,220,525 (Petrovich) teaches that polyhydroxyamines are useful as depressants for gangue minerals including silica, silicates, carbonates, sulfates and phosphates in the recovery of non-sulfide mineral values. Illustrative examples of the polyhydroxyamines disclosed Include aminobutanetriols, aminopartitols, aminohexitols, aminoheptitois, aminooctitols, pentose-amines, hexose amines, amino-tetrols etc. U.S. Pat. No. 4,360,425 (Lim et al) describes a method for improving the results of a froth flotation process for the recovery of non-sulfide mineral values wherein a synthetic depressant is added which contains hydroxy and carboxy functionalities. Such depressants are added to the second or amine stage flotation of a double float process for the purpose of depressing non-sulfide value minerals such as phosphate minerals during amine flotation of the siliceous gangue from the second stage concentrate. This patent relates to the use of synthetic depressant during amine flotations only.

In view of the forgoing and especially in view of the teachings of U.S. Pat. No. 4,902,764 which teaches the use of certain polyacrylamide-based copolymers and terpolymers for sulfide mineral depression during the recovery of value sulfide minerals, we have unexpectedly found that certain polymers are indeed excellent depressants for non-sulfide silicate gangue minerals (such as talc, pyroxenes, olivines, serpentine, pyrophyllite, chlorites, biotites, amphiboles, etc.). This result is unexpected because such depressants have been disclosed only as sulfide gangue depressants. These synthetic depressants have now been found to be excellent alternatives to the polysaccharides used currently since they are readily miscible or soluble in water, are non-hazardous and their water solutions are stable. The use thereof will increase the availability of the polysaccharides as a valuable human food source and their performance is not variable. They can be manufactured to adhere to stringent specifications and, accordingly, batch-to-batch consistency is guaranteed. Unlike the polysaccharides which are natural products, these synthetic polymers lend themselves readily to modification of their structure, thereby permitting tailor-making of depressants for a given application.

SUMMARY OF THE INVENTION

In accordance with the present invention there is provided a method which comprises beneficiating value sulfide minerals from ores with the selective rejection of non-sulfide silicate gangue minerals by:

a. providing an aqueous pulp slurry of finely-divided, liberation-sized ore particles which contain said value sulfide minerals and said non-sulfide silicate gangue minerals;

b. conditioning said pulp slurry with an effective amount of non-sulfide silicate gangue mineral depressant, a value sulfide mineral collector and a frothing agent, said depressant comprising a polymer comprising:

(i) x units of the formula:

$$+X+$$

(ii) y units of the formula:

$$+Y+$$

(iii) z units of the formula:

$$+Z+$$

wherein X is the polymerization residue of an acrylamide monomer or mixture of acrylamide monomers, Y is an hydroxy group containing polymer unit, Z is an anionic group containing polymer unit, x represents a residual mole percent fraction of at least about 35%, y is a mole percent fraction ranging from about 1 to about 50% and z is a mole percent fraction ranging from about 0 to about 50% and c. collecting the value sulfide mineral having a reduced content of non-sulfide silicate gangue minerals by froth flotation.

DESCRIPTION OF THE INVENTION INCLUDING PREFERRED EMBODIMENTS

The depressants of the above formula may comprise, as the (i) units, the polymerization residue of such acrylamides as acrylamide per se, alkyl acrylamides such as methacrylamide, ethacrylamide and the like.

The (ii) units may comprise the polymerization residue of monoethylenically unsaturated hydroxyl group containing copolymerization monomers such as hydroxyalkylacrylates and methacrylates e.g. 1,2-dihydroxypropyl acrylate or methacrylate; hydroxyethyl acrylate or methacrylate; glycidyl methacrylate, acrylamido glycolic acid;

hydroxyalkylacrylamides such as N-2-hydroxyethylacrylamide; N-1-hydroxypropylacrylamide; N-bis(1,2-dihydroxyethyl)acrylamide; N-bis(2-hydroxypropyl)acrylamide; and the like.

It is preferred that the (ii) units monomers be incorporated into the polymeric depressant by copolymerization of an appropriate hydroxyl group containing monomer, however, it is also permissible to impart the hydroxyl group substituent to the already polymerized monomer residue by, for example, hydrolysis thereof or pest-reaction of a group thereof susceptible to attachment of the desired hydroxyl group with the appropriate reactant material e.g. glyoxal, such as taught in U.S. Pat. No. 4,902,764, hereby incorporated herein by reference. Glyoxylated polyacrylamide should, however, contain less than about 50 mole percent glyoxylated amide units, i.e. preferably less than about 40 mole percent, more preferably less than 30 mole percent, as the Y units. It is preferred that the Y units of the above formula be a non-α-hydroxyl group of the structure $$\begin{array}{l} +CH_2-CH+ \\ \quad\quad\;\; | \\ \quad\quad\;\; C=O \\ \quad\quad\;\; | \\ \quad\quad\;\; A-CHR-(CHR^1)_n-OH \end{array}$$

wherein A is O or NH, R and $R^1$ are, individually, hydrogen or a $C_1$–$C_4$ alkyl group and n is 1–3, inclusive.

The (iii) units of the polymers useful as depressants herein comprise the polymerization residue of an anionic group containing monoethylenically unsaturated, copolymerzable monomer such as acrylic acid, methacrylic acid, alkali metal or ammonium salts of acrylic and/or methacrylic acid, vinyl sulfonate, vinyl phosphonate, 2-acrylamido-2-methyl propane sulfonic acid, styrene sulfonic acid, maleic acid, fumaric acid, crotonic acid, 2-sulfoethylmethacrylate; 2-acrylamido-2-methyl propane phosphonic acid and the like.

Alternatively, but less desirably, the anionic substituents of the (iii) units of the polymers used herein may be imparted thereto by post-reaction such as by hydrolysis of a portion of the (i) unit acrylamide polymerization residue of the polymer as also discussed in the above-mentioned '764 patent.

The effective weight average molecular weight range of these polymers is surprisingly very wide, varying from about a few thousand e.g. 5000, to about millions e.g. 10 million, preferably from about ten thousand to about one million.

The dosage of depressant useful in the method of the present invention ranges from bout 0.01 to about 10 pounds of depressant per ton of ore, preferably from about 0.1 to about 5 lb/ton, most preferably from about 0.1 to about 1.0 lb./ton.

The concentration of (i) units in the depressants used herein should be at least about 35% as a mole percent fraction of the entire polymer, preferably at least about 50%. The concentration of the (ii) units should range from about I to about 50%, as a mole percent fraction, preferably from about 5 to about 20%, while the concentration of the (ill) units should range from about 0 to about 50%, as a mole percent fraction, preferably from about 1 to about 50% and more preferably from about I to about 20%. Mixtures of the polymers composed of the above X, Y and Z units may also be used in ratios of 9:1 to 1:9.

The new method for beneficiating value sulfide minerals employing the synthetic depressants of the present Invention provides excellent metallurgical recovery with improved grade. A wide range of pH and depressant dosage are permissible and compatibility of the depressants with frothers and sulfide value mineral collectors is a plus.

The present invention is directed to the selective removal of non-sulfide silicate gangue minerals that normally report to the value sulfide mineral flotation concentrate, either because of natural floatability or hydrophobicity or otherwise. More particularly, the instant method effects the depression of non-sulfide magnesium silicate minerals while enabling the enhanced recovery of sulfide value minerals. Thus, such materials may be treated as, but not limited to, the following:

Talc
Pyrophyllite
Pyroxene group of Minerals
Diopside
Augite
Homeblendes
Enstatite
Hypersthene
Ferrosilite
Bronzite
Amphibole group of minerals
Tremolite
Actinolite
Anthophyllite
Biotite group of minerals
Phlogopite
Biotite
Chlorite group of minerals
Serpentine group of minerals
Serpentine
Chrysotile
Palygorskite
Lizardite
Anitgorite
Olivine group of minerals
Olivine
Forsterite
Hortonolite
Fayalite The following examples are set forth for purposes of illustration only and are not to be construed as limitations on the present invention except as set forth in the appended claims. All parts and percentages are by weight unless otherwise specified. In the examples, the following designate the monomers used:

AMD=acrylamide
DHPM=1,2-dihydroxypropyl methacrylate
HEM=2-hydroxyethyl methacrylate
AA=acrylic acid
MAMD=methacrylamide
VP=vinylphosphonate
GPAM=glyoxylated poly(acrylamide)
APS=2-acrylamido-2-methylpropane sulfonic acid
VS=vinylsulfonate
CMC=carboxymethyl cellulose
t-BAMD=t-butylacrylamide
HPM=2-hydroxpropyl methacrylate
HEA=1-hydroxethyl acrylate
HPA=1-hyrdoxypropyl acrylate
DHPA=1,2-dihydroxypropyl acrylate
NHE-AMD=N-2-hydroxyethylacrylamide
NHP-AMD=N-2-hydroxypropylacrylamide
NBHE-AMD=N-bis(1,2-dihydroxyethyl)acrylamide
NBEP-AMD=N-bis( 1-hydroxypropyl)acrylamide
SEM=2-sulfethylmethacrylate
AMPP=2-acrylamido-2-methylpropane phosphonic acid
C=comparative

EXAMPLES 1–41

Test Procedures

Pure Talc Flotation

The depressant activity of the polymers is tested using a high grade talc sample in a modified Hallimond tube. 1 Pad of talc of size −200+400 mesh is suspended in water and conditioned for 5 min. at the desired pH. A known amount of polymer depressant solution is added and the talc is further conditioned for 5 min. The conditioned talc is then transferred to a flotation cell, and flotation is conducted by passing nitrogen gas for a prescribed length of time. The floated and unfloated talc are then filtered separately, dried and weighed. Per cent flotation is then calculated from these weights.

The depressant activity (as measured by % talc flotation; the lower the talc flotation, the greater is the depressant activity) of depressants having varying molecular weights is shown in Table 1. These examples clearly demonstrate that the polymer depressants of the present invention depress talc flotation. In the absence of any polymer, talc flotation is 98%; in the presence of the polymers, talc flotation is in the range of 5 to 58%. The depressant activity, in general, is greater at the high molecular weight. The depressant activity also increases with the proportion of the hydroxy group containing comonomer.

TABLE 1

Depressant Concentration: 100 ppm; 8 min. flotation; pH 9

| Example | Depressant | % Talc Flotation |
|---|---|---|
| 1C | None | 98 |
| 2 | AMD/DHPM, 95/5, MW 10,000 | 31 |
| 3 | AMD/DHPM, 90/10, MW 10,000 | 22 |
| 4 | AMD/DHPM, 80/20, MW 10,000 | 19 |
| 5 | AMD/DHPM, 50/50, MW 10,000 | 20 |
| 6 | AMD/HEM, 95/5, MW 10,000 | 56 |
| 7 | AMD/HEM, 90/10, MW 10,000 | 23 |
| 8 | AMD/DHPM, 90/10, MW 3,000 | 58 |
| 9 | AMD/DHPM, 90/10, MW 10,000 | 32 |
| 10 | AMD/DHPM, 90/10, MW 20,000 | 25 |
| 11 | AMD/DHPM, 90/10, MW 297,000 | 22 |
| 12 | AMD/DHPM, 90/10, MW 397,000 | 5 |
| 13 | AMD/DHPM, 90/10, MW 878,000 | 7 |
| 14 | AMD/HEM, 90/10, MW 3000 | 45 |
| 15 | AMD/HEM, 90/10, MW 10,000 | 12 |
| 16 | AMD/HEM, 90/10, MW 20,000 | 13 |
| 17 | AMD/HEM, 90/10, MW 116,000 | 15 |
| 18 | AMD/HEM, 90/10, MW 286,000 | 20 |
| 19 | AMD/HEM, 90/10, MW 458,000 | 18 |
| 20 | AMD/HEM, 90/10, MW 656,000 | 18 |
| 21 | AMD/DHPM/AA 80/10/10, MW 7000 | 24 |
| 22 | AMD/HEM/AA 80/10/10, MW 8800 | 38 |

The depressant activity at varying dosage of various polymer depressants of the present invention at molecular weights of 10,000 and 300,000 is given in Table 2. In general, the depressant activity increases with the dosage of the polymer. At the high molecular weight, the dosage of the polymer required for a given depression is significantly low.

TABLE 2 pH 9; 8 min. Flotation

| Example | Depressant | % Talc Flotation |
|---|---|---|
| 23C | None | 98 |
| 24 | AMD/DHPM, 90/10, MW 10,000, 5 ppm | 70 |
| 25 | AMD/DHPM, 90/10, MW 10,000, 10 ppm | 59 |
| 26 | AMD/DHPM, 90/10, MW 10,000, 40 ppm | 40 |
| 27 | AMD/DHPM, 90/10, MW 10,000, 100 ppm | 21 |
| 28 | AMD/HEM, 90/10, MW 10,000, 5 ppm | 52 |
| 29 | AMD/HEM, 90/10, MW 10,000, 10 ppm | 28 |
| 30 | AMD/HEM, 90/10, MW 10,000, 100 ppm | 22 |
| 31 | AMD/DHPM, 90/10, MW 300,000, 1 ppm | 30 |

TABLE 2-continued pH 9; 8 min. Flotation

| Example | Depressant | % Talc Flotation |
|---|---|---|
| 32 | AMD/DHPM, 90/10, MW 300,000, 2.5 ppm | 12 |
| 33 | AMD/DHPM, 90/10, MW 300,000, 100 ppm | 5 |
| 34 | AMD/HEM, 90/10, MW 300,000 1 ppm | 42 |
| 35 | AMD/HEM, 90/10, MW 300,000 10 ppm | 20 |
| 36 | AMD/HEM, 90/10, MW 300,000 100 ppm | 20 |

The depressant activity of a 90/10 acrylamide/dihydroxypropylmethacrylate copolymer at different pH values is given in Table 3. These results demonstrate that the depressant activity is maintained in the wide pH range of 3.5–11.

TABLE 3

AMD/DHPM 90/10: MW 10,000;
DOSAGE 100 PPM; 8 MIN. FLOTATION
NO DEPRESSANT: 95–98% FLOTATION
IN THE pH RANGE USED

| Example | pH | % Talc Flotation |
|---|---|---|
| 37 | 3.5 | 20 |
| 38 | 5 | 35 |
| 39 | 7 | 25 |
| 40 | 9 | 23 |
| 41 | 11 | 26 |

EXAMPLES 42–45

Natural Sulfide Ore Flotation

Ore 1

This ore containing approximately 2.25% Ni and 28% MgO (in the form of Mg silicates) is ground in a laboratory rod mill to obtain a pulp at size of 80% –200 mesh. This pulp is transferred to a flotation cell, conditioned at the natural pH (~8.5) with 200 parts/ton of copper sulfate for 4 min., then with 175 parts/ton of sodium ethyl xanthate for 2 min., followed by conditioning with the desired amount of the polymer depressant and an alcohol frother for 1 min. Flotation is then carded out by passing air at approximately 5.5 Vmin., and four concentrates are taken. The concentrates and the tails are then filtered, dried and assayed. The results for two terpolymers depressants of the present invention are compared with those of guar gum in Table 4. The objective here is to decrease the Mg-silicate recovery (as identified by MgO as an Indicator) into the sulfide flotation concentrate while maintaining as high a Ni recovery and Ni grade as possible. The results in Table 4 demonstrate that the two terpolymer depressants of the present invention provided about 3 units lower MgO recovery while providing equal of slightly better Ni recovery and Ni grade at only 75% of the guar gum dosage. In the absence of any depressant, the MgO recovery is much higher (27%) which is unacceptable.

TABLE 4

Feed Assay: 2.25% Ni and 27.7 MgO

| Example | Depressant | p/t | Cum. Wt. %. C1–4 | Ni Rec. | Ni Grade | MgO Rec. |
|---|---|---|---|---|---|---|
| 42C | None | 0 | 36.87 | 80.5 | 5.0 | 27.0 |
| 43C | Guar Gum | 175 | 31.10 | 76.1 | 5.4 | 21.5 |

TABLE 4-continued

Feed Assay: 2.25% Ni and 27.7 MgO

| Example | Depressant | p/t | Cum. Wt. %. C1–4 | Ni Rec. | Ni Grade | MgO Rec. |
|---|---|---|---|---|---|---|
| 44 | AMD/DHPM/AA 80/10/10, 7K | 130 | 27.88 | 77.6 | 6.4 | 18.6 |
| 45 | AMD/HEM/AA 80/10/10, 9K | 130 | 26.98 | 75.1 | 6.3 | 18.5 |

EXAMPLES 46–65

Ore 2

This ore containing approximately 3.3% Ni and 17.6% MgO (in the form of Mg silicates) is ground in a laboratory rod mill for 5 min. to obtain a pulp at a size of 81% –200 mesh. The ground pulp is then transferred to a flotation cell, and is conditioned at the natural pH (~8–8.5) with 150 parts/ton of copper sulfate for 2 min., 50 to 100 parts/ton of sodium ethyl xanthate for 2 min. and then with the desired amount of a depressant and an alcohol for 2 min. First stage flotation is then conducted by passing air at approximately 3.5–5 V/min. and a concentrate is collected. In the second stage, the pulp is conditioned with 10 parts/ton of sodium ethyl xanthate, and desired amounts of the depressant and the frother for 2 min. and a concentrate is collected. The conditions used in the second stage are also used in the third stage and a concentrate is collected. All of the flotation products are filtered, dried and assayed.

In Table 5, the depressant activity of several copolymer and terpolymer depressants is compared with that of guar gum at two different dosages. In the absence of any depressant, the Ni recovery is 96.6% which is considered very high and desirable; the MgO recovery is 61.4% which is also very high, but considered highly undesirable. The Ni grade of 4.7% obtained is only slightly higher than that in the original feed. With guar gum at 420 and 500 parts/ton, the MgO recovery is in the range of 28.3 to 33.5% which is considerably lower than that obtained in the absence of a depressant, and Ni recovery is about 93% which is lower than that obtained in the absence of depressant. A reduction in Ni recovery is to be expected in the process of reducing MgO recovery since there is invariably some mineralogical association of Ni minerals with the Mg-silicates; when the latter are depressed, some Ni minerals are also depressed. The synthetic polymer depressants of the present invention show much stronger depressant activity than guar gum; the MgO recoveries are in the range of 6.3 to 15.3% compared with 28.3–33–5% for guar gum. These results indicate that significantly lower dosage of the synthetic depressants can be used if results similar to those of guar gum are desired. The terpolymer containing 10 parts each of methacrylamide and dihydroxypropyl methacrylate provides depressant activity that is similar to that of guar gum. Similarly, a terpolymer of AMD, DHPM and vinyl phosphonate provides metallurgy that is similar to guar gum.

It is pertinent to note here that polyacrylamide reacted with glyoxylic acid, containing pendant hydroxyl and carboxyl groups, shows depressant activity at a degree of substitution of 10% (i.e. 10 parts of the amide groups in the polyacrylamide are reacted with glyoxylic acid.) At a degree of substitution of 50%, depressant activity is weaker.

TABLE 5

| Feed Assay: 3.31% Ni and 17.58% MgO | | | | | |
|---|---|---|---|---|---|
| Example | Depressant | p/t | Ni Rec. | Ni Grade | MgO Rec. |
| 46C | None | 0 | 96.6 | 4.7 | 61.4 |
| 47C | Guar Gum | 350 + 70 + 80 | 93.0 | 7.7 | 28.3 |
| 48C | Guar Gum | 300 + 60 + 60 | 92.9 | 6.7 | 33.5 |
| 49 | AMD/DHPM 90/10, 397K | 350 + 60 + 60 | 84.5 | 10.5 | 12.6 |
| 50 | AMD/DHPM 90/10, 878K | 350 + 70 + 80 | 81.8 | 12.6 | 8.2 |
| 51 | AMD/DHPM 90/10, 878K | 280 + 56 + 64 | 84.2 | 8.0 | 15.3 |
| 52 | AMD/DHPM 80/20, 500K | 350 + 70 + 80 | 80.3 | 11.5 | 9.8 |
| 53 | AMD/DHPM 80/20, 800K | 350 + 70 + 80 | 71.4 | 11.8 | 6.3 |
| 54 | AMD/MAMD/ DHPM 80/10/10, 6.23K | 350 + 85 + 100 | 92.3 | 7.2 | 37.6 |
| 55 | AMD/MAMD/VP 80/10/10, 12.1K | 350 + 85 + 100 | 93.1 | 7.8 | 31.8 |
| 56 | GPAM (90/10) | 350 + 70 + 80 | 93.3 | 6.3 | 43.7 |
| 57C | GPAM (50/50) | 350 + 70 + 80 | 99.0 | 4.7 | 63.4 |
| 58 | AMD/HPM 90/10 | 350 + 85 + 100 | 94.6 | 6.4 | 44.0 |
| 59 | AMD/HEM 90/10, 656K | 250 + 60 + 70 | 86.4 | 7.0 | 27.9 |
| 60 | AMD/DHPM/ HEM 95/5/5 | 280 + 56 + 64 | 84.1 | 6.9 | 23.9 |
| 61 | AMD/DHPM/AA 80/10/10, 750K | 250 + 60 + 70 | 91.8 | 5.6 | 39.2 |
| 62 | AMD/DHPM/AA 80/10/10, 750K | 280 + 56 + 64 | 89.6 | 6.2 | 28.1 |
| 63 | AMD/DHPM/AA 85/10/5, 800K | 280 + 56 + 64 | 89.6 | 7.2 | 24.6 |
| 64 | AMD/DHPM/APS 80/10/10, 11.7K | 250 + 60 + 70 | 95.0 | 6.5 | 47.5 |
| 65 | AMD/DHPM/VS 80/10/10, 7.78K | 250 + 60 + 70 | 94.1 | 7.0 | 42.9 |
| 65A | Polymer of Examples 59 and 61 in a ratio of 1:1 | 350 + 70 + 80 | 92.5 | 10.3 | 16.8 |

EXAMPLES 66–79

Ore 3

This ore has approximately 2.1% Ni and 17% MgO. 1000 Parts of ore is ground in a rod mill to obtain a pulp that has a size of 80% passing 20 mesh. The ground pulp is conditioned for 2 min. with 200 parts/ton of copper sulfate, 2 min. with 100 parts/ton of sodium ethyl xanthate and the required amount of frother, and then for 2 min. with the desired amount of the depressant. Flotation is then conducted by passing air, and a concentrate is taken. In the second stage, the pulp is conditioned with 40 parts/ton of xanthate and additional amounts of the same depressant, and a second concentrate is taken. A third stage flotation is conducted similarly and a concentrate is taken. All of the flotation products are filtered, dried and assayed.

The results for the depressant activity of several of the synthetic copolymer and terpolymer depressants of the present invention are compared with that of guar gum (at two dosages) in Table 6. These results demonstrate clearly that the depressants provide metallurgy that is equal or better than that of guar gum at 40 to 70% of the guar gum dosage. In many examples, improved Ni recovery is obtained while maintaining a low MgO recovery indicating gangue silicate mineral depression.

TABLE 6

| Feed Assay: Ni 2.06%; MgO 17% — Xanthate Rougher Float | | | | | | |
|---|---|---|---|---|---|---|
| Example | Depressant | Dose p/t | Cum. Wt. % | Grade Ni | Cum. Rec. % Ni | Cum. Rec. % MgO |
| 66C | GUAR | 200 | 27.9 | 6.11 | 84.6 | 13.1 |
| 67C | GUAR | 250 | 27.0 | 6.31 | 84.4 | 12.1 |
| 68 | AMD/DHPM 90/10, 397K | 100 | 29.4 | 6.20 | 86.6 | 13.5 |
| 69 | AMD/DHPM 90/10, 397K | 140 | 27.5 | 6.29 | 85.6 | 12.7 |
| 70 | AMD/DHPM 90/10, 878K | 100 | 28.0 | 6.45 | 85.6 | 12.5 |
| 71 | AMD/DHPM 90/10, 878K | 180 | 28.3 | 6.39 | 84.8 | 12.8 |
| 72 | AMD/HEM 90/10, 286K | 140 | 27.9 | 6.22 | 85.1 | 12.8 |
| 73 | AMD/HEM 90/10, 286K | 180 | 26.7 | 6.66 | 84.4 | 10.9 |
| 74 | AMD/HEM 90/10, 656K | 100 | 27.9 | 6.54 | 85.2 | 12.1 |
| 75 | AMD/HEM 90/10, 656K | 180 | 26.6 | 6.50 | 83.7 | 11.2 |
| 76 | AMD/DHPM/AA 80/10/10, 750K | 140 | 28.3 | 6.15 | 84.5 | 12.6 |
| 77 | AMD/DHPM/AA 80/10/10, 750K | 180 | 27.8 | 6.48 | 85.4 | 12.4 |
| 78 | AMD/HEM/AA 80/10/10, 224K | 140 | 28.9 | 6.18 | 86.0 | 13.8 |
| 79 | AMD/HEM/AA 80/10/10, 224K | 180 | 27.4 | 6.33 | 84.2 | 12.5 |

EXAMPLES 80–83

Ore 4

This ore containing approximately 0.6% Ni and about 38% MgO (in the form of Mg silicates) is ground in a laboratory rod mill to obtain a pulp at a size of 80% –200 mesh. This ground pulp is deslimed, conditioned for 20 min. with 120 parts/ton of sodium ethyl xanthate and the desired amount of frother. Flotation is then conducted and a concentrate is collected for 4 min. This concentrate is then conditioned for I min. with 20 parts/ton of sodium ethyl xanthate and with the specified amount of the depressant. A cleaner flotation is then carded out for 3.5 min. The concentrate and tails are then filtered, dried and assayed.

The results for the depressant activity of three synthetic polymer depressants are compared with that of guar gum in Table 7. It is again evident from the results in Table 7 that the synthetic depressants of this invention provide metallurgy that is equal to or better than guar gum at 40 to 80% of the guar dosage. With two of the depressants the Ni recovery is significantly improved while maintaining low MgO recoveries.

TABLE 7

| Example | Depressant | Dose (p/t) | Cum. Wt. % | Grade Ni | Cum. Recovery Ni | Cum. Recovery MgO |
|---|---|---|---|---|---|---|
| 80C | Guar | 30 | 3.8 | 9.2 | 62.6 | 2.3 |
| 81 | AMD/DHPM 90/10, 397K | 15 | 4.4 | 9.1 | 65.8 | 2.6 |
| 82 | AMD/DHPM 90/10, 397K | 12.5 | 4.7 | 7.5 | 66.2 | 3.0 |

TABLE 7-continued

| Example | Depressant | Dose (p/t) | Cum. Wt. % | Grade Ni | Cum. Recovery Ni | Cum. Recovery MgO |
|---|---|---|---|---|---|---|
| 83 | AMD/HEM/AA 80/10/10, 224K | 24 | 3.8 | 9.0 | 61.7 | 2.4 |

EXAMPLES 84–96

Ore 5

This ore containing small amounts of Ni, Cu and Fe in the form of sulfides, small amounts of platinum and palladium, and approximately 7.5% MgO (in the form of Mg silicates) is ground in a laboratory rod mill with 15 parts/ton of potassium amyl xanthate and 12.5 parts/ton of diisobutyl dithiophosphate for 10 min. to obtain a pulp at a size of 40% −200 mesh. The ground pulp is then transferred to a flotation cell, and is conditioned for 2 min. at the natural pH (~8.2) with the same amounts of collectors as in the grind, followed by conditioning with the specified amount of depressant and an alcohol frother for 2 min. Flotation is then conducted by passing approximately 3.5–5 V/min. of air and a concentrate is collected. The procedure used in the first stage of flotation is followed in the second stage and a second concentrate is collected. The flotation products are then filtered, dried and assayed.

The results for the depressant activity of a variety of synthetic polymer depressants of the present invention are compared in Table 8 with that of two carboxy methyl cellulose samples from different sources. The objective here is to obtain high recovery and grades of Pt and Pd in the concentrate. In the absence of any depressant, the recovery of Pt and Pd is indeed very high (97.5% and 94–95% respectively), but the concentrate grades are unacceptably low. With the CMC depressants, the Pt and Pd recoveries are 95–96.5% and 92–94.6%, respectively, and the grades are 3–3.1 for Pt and 12.7–13 for Pd. It is evident from the results that the synthetic polymer depressants provide Pt and Pd metallurgy that is equal to or better than that of CMC samples and at significantly lower dosages (60–80% of the CMC dosage). It is also evident that the synthetic polymer depressants provide better grades for the Pt which is a more important and much higher value metal than Pd. In Example 88, a polymer containing only 0.5 part of the t-butyl acrylamide in addition to DHPM provides Pt metallurgy that is equal to that of CMC(B) but at 80% of the dosage of CMC.

TABLE 8

| Example | Depressant | p/t | Pt Rec. | Pt Grade | Pd Rec. | Pd Grade |
|---|---|---|---|---|---|---|
| | Feed Assay: 5.8 p/t Pt; 22 p/t Pd | | | | | |
| 84C | None | 0 | 97.5 | 1.6 | 95.0 | 6.0 |
| 85C | None | 0 | 97.6 | 2.3 | 94.4 | 7.2 |
| 86C | CMC-A | 500 | 95.2 | 3.1 | 92.0 | 12.7 |
| 87C | CMC-B | 500 | 96.5 | 3.0 | 94.6 | 13.0 |
| 88 | AMD/DHPM/ t-BAMD 89.5/10/0.5 | 400 | 96.5 | 3.1 | 93.1 | 11.6 |
| 89 | AMD/DHPM/AA 80/10/10, 750K | 400 | 96.6 | 2.1 | 93.2 | 7.4 |
| 90 | AMD/DHPM/AA 80/10/10, 750K | 500 | 92.9 | 4.6 | 88.3 | 14.7 |
| 91 | AMD/HEM/AA 80/10/10, 224K | 370 | 94.5 | 3.8 | 92.1 | 13.9 |
| 92 | AMD/HEM/AA 80/10/10, 224K | 300 | 95.3 | 4.2 | 91.4 | 16.4 |
| 93 | AMD/HEM/AA 80/10/10, 224K | 400 | 96.6 | 2.7 | 94.1 | 10.6 |
| 94 | AMD/DHPM/AA 85/10/5 | 400 | 96.8 | 3.2 | 93.4 | 11.2 |
| 95 | AMD/DHPM/VP 80/10/10, 12K | 370 | 96.9 | 2.8 | 94.1 | 10.4 |
| 96 | AMD/DHPM/ MAMD 80/10/10 | 400 | 94.8 | 1.6 | 91.9 | 6.5 |

EXAMPLES 97–99

Ore 6

This ore contains 0.85% Ni and 39% MgO. 1000 Parts of the ore are ground in a rod mill to give a flotation feed of size 80% passing 200 mesh. The ground pulp is conditioned for 30 min. with the desired amount of a depressant along with 500 parts/ton sodium ethyl xanthate. Rougher flotation is then carded out for 25 min. The rougher concentrate is then conditioned with the specified amount of depressant and 10 parts/ton of sodium ethyl xanthate and a cleaner flotation is carded out for 15 min. The flotation products are filtered, dried and assayed.

The results for two synthetic copolymers of AMD/DHPM are compared with that of CMC in Table 9. These results demonstrate that the sythetic depressants provide metallurgy that is equal to or better than that of CMC, but at about 27% of the CMC dosage. In the case of the copolymer with a molecular weight of 878,000, the MgO recovery in both the regular and cleaner concentrate is significantly lower than that obtained with CMC.

TABLE 9

| Feed Assay: Ni 0.85%; MgO 39% | | | | | | | |
|---|---|---|---|---|---|---|---|
| | | Dose p/t | | Grade | Cum. Recovery, % | | |
| Example | Depressant | Total | Product | Ni | Wt | Ni | MgO |
| 97C | CMC | 275 | 1ClCon | 15.44 | 3.48 | 60.8 | 2.3 |
| | | | RoCon | 3.21 | 21.17 | 76.8 | 20.6 |
| 98 | AMD/DHPM 90/10, 878K | 75 | 1ClCon | 18.01 | 2.73 | 59.3 | 1.5 |
| | | | RoCon | 3.78 | 15.92 | 72.6 | 14.6 |
| 99 | AMD/DHPM 90/10, 397K | 75 | 1ClCon | 14.48 | 3.41 | 61.6 | 2.1 |
| | | | RoCon | 2.83 | 21.96 | 77.6 | 20.7 |

EXAMPLES 100–109

Ore 7

This ore containing small amounts of Ni, Cu, and Fe in form of sulfides and about 17% MgO (in the form of Mg silicates) is ground in a laboratory ball mill for 12 min. to obtain a pulp at a size of 40% –200 mesh. The ground pulp is then transferred to a flotation cell, and is conditioned at the natural pH (~7.2) with the specified amount of a depressant for 3 min., followed with 16 parts/ton of sodium isobutyl xanthate and 34 parts/ton of a dithiophosphate and a polyglycol frother for 3 min. Flotation is then conducted by passing air at approximately 3.5 V/min. and two concentrates are collected. The flotation products are then filtered, dried and assayed.

The results for the depressant activity of a variety of synthetic polymer depressants of the present invention are compared with that of a modified guar in Table 10. The objection here is to minimize the recovery of SiO2, CaO, MgO, Al203—all of which represent the silicate minerals present in the sulfide concentrates—and to maintain or improve the recovery of Ni and Cu which constitute the value sulfide minerals. In the absence of any depressant, the Ni and Cu recoveries are 49.5% and 79%, respectively, but the recovery of the gangue constituents is very high (9.4% for SiO2, 7.4% for CaO, 10.6% for MgO and 5.8% for Al203). With guar, both the Ni and Cu recoveries are slightly reduced, perhaps because of depression of some silicate minerals that carry Ni and Cu sulfides as mineral locking, but recovery of the gangue constituents is also reduced. With all of the synthetic polymer depressants tested, there is a significant reduction in the recovery of the gangue constituents, and with some of them the reduction is far greater than that obtained with guar. All of the depressants of the present invention (except one) give higher copper recoveries than guar; in some cases the copper recoveries are higher than that obtained in the absence of the depressant, Also the Ni recoveries obtained with the synthetic depressants are either equal to or much greater than that obtained with guar. In the best case, AMD/HEM 90/10, 10,000 MW, them is more than 50% reduction in SiO2 compared to the test with no depressant, and 44% reduction in SiO2 compared to that with guar. Similarly significant reductions are also observed for other gangue constituents.

TABLE 10

| Calculated Head Assays: Cu — 0.07%, Ni — 0.20%; SiO2 — 48.8%; CaO — 5.8% MgO — 17%; Al2O3 — 9% | | | | | | | | | |
|---|---|---|---|---|---|---|---|---|---|
| Example | Depressant | p/t | Order of Addn. | Copper Rec | Nickel Rec | SiO2 Rec | CaO Rec | MgO Rec | Al2O3 Rec |
| 100C | None | 0 | — | 79.0 | 49.5 | 9.4 | 7.4 | 10.6 | 5.8 |
| 101C | Guar | 60 | Depr 1st | 77.2 | 46.2 | 7.5 | 5.9 | 8.6 | 4.8 |
| 102 | AMD/HEM 95/5 100k | 60 | Depr 1st | 75.9 | 46.3 | 8.5 | 6.8 | 9.5 | 5.6 |
| 103 | AMD/HEM 90/10 20k | 60 | Depr 1st | 78.3 | 48.6 | 8.0 | 6.4 | 9.2 | 5.2 |
| 104 | AMD/HEM 90/10 10k | 70 | Depr 1st | 81.3 | 51.0 | 7.3 | 5.9 | 8.2 | 4.9 |
| 105 | AMD/HEM 90/10 10k | 70 | Reverse | 82.4 | 50.1 | 4.2 | 5.1 | 7.5 | 3.9 |
| 106 | AMD/DHPM 80/20 10k | 67 | Depr 1st | 79.4 | 46.5 | 6.5 | 4.9 | 7.4 | 3.8 |
| 107 | AMD/DHPM 90/10 10k | 60 | Depr 1st | 79.3 | 48.2 | 7.4 | 5.9 | 8.5 | 4.7 |
| 108 | AMD/DHPM 90/10 10k | 60 | Reverse | 80.2 | 47.5 | 6.5 | 5.0 | 7.5 | 4.0 |
| 109 | AMD/DHPM/AA 80/10/10 10k | 60 | Depr 1st | 78.4 | 46.3 | 7.2 | 5.9 | 8.2 | 4.9 |

EXAMPLE 110

Following the procedure of Example 50 except that the DHPM is replaced by an equivalent amount of HEA. Similar results are attached.

EXAMPLE 111

Replacing the HEM of Example 45 with DHPA achieves substantially similar results.

EXAMPLES 112

Example 53 is again followed but the DHPM is replaced by HPA to achieve similar recovery.

EXAMPLE 113

When the HEM of Example 73 is replaced by NHE-AMD similar cumulative recovery of nickel and magnesium is observed.

EXAMPLE 114

NBHE-AMD is used to replace DHPM in the Example 88 procedure. The results are similar.

EXAMPLE 115

The DHPM of Example 96 is replaced by NHP-AMD to yield similar platinum and palladium recoveries.

EXAMPLE 116

Metal recoveries are similar when the HEM of Example 102 is replaced by NBEP-AMD.

EXAMPLE 117

Replacement of the AA of Example 22 by SEM results in similar % talc flotation.

EXAMPLE 118

When the VP of Example 55 is replaced by AMPP, similar results are achieved.

We claim:

1. A method which comprises beneficiating value sulfide minerals from ores with selective rejection of non-sulfide silicate gangue minerals by:

a. providing an aqueous pulp slurry of finely-divided, liberation-sized ore particles which contain said value sulfide minerals and said non-sulfide silicate gangue minerals;

b. conditioning said pulp slurry with an effective amount of non-sulfide silicate gangue mineral depressant, a value sulfide mineral collector and a frothing agent, respectively, said depressant comprising a polymer or a mixture of polymers comprising:

(i) x units of the formula:

$$+X+$$

(ii) y units of the formula:

$$+Y+$$

(iii) z units of the formula:

$$+Z+$$

wherein X is the polymerization residue of an acrylamide monomer or mixture of such acrylamide monomers, Y is a hydroxy group containing polymer unit derived from a monoethylenically unsaturated monomer, Z is an anionic group containing polymer unit derived from a monoethylenically unsaturated monomer, x represents a residual mole percent fraction of over about 35%, y is a mole percent fraction ranging from about 1 to about 50% and z is a mole percent fraction ranging from about 0 to about 50% and c. subjecting the conditioned pulp slurry to froth flotation and collecting the value sulfide mineral having a reduced content of non-sulfide silicate gangue minerals.

2. A method according to claim 1 wherein Y has the formula $$\begin{array}{l} +CH_2-CH+ \\ \quad\;\; | \\ \quad\;\; C=O \\ \quad\;\; | \\ \quad\;\; A \\ \quad\;\; | \\ \quad\;\; CHR-(CHR^1)_n-OH \end{array}$$

wherein A is O or NH, R and $R^1$ are, individually, hydrogen or a $C_1$–$C_4$ alkyl group and n is 1–3, inclusive.

3. A method according to claim 1 wherein X is the polymerization residue of acrylamide, Y is the polymerization residue of 1,2-dihydroxypropyl methacrylate and z is 0.

4. A method according to claim 1 wherein X is the polymerization residue of acrylamide, Y is the polymerization residue of 1,2-dihydroxypropyl methacrylate, Z is the polymerization residue of acrylic acid and z is a mole percent fraction ranging from about 1 to about 50.

5. A method according to claim 1 wherein X is the polymerization residue of acrylamide, Y is the polymerization residue of hydroxyethyl methacrylate and z is 0.

6. A method according to claim 1 wherein X is the polymerization residue of acrylamide, Y is the polymerization residue of hydroxyethyl methacrylate, Z is the polymerization residue of acrylic acid and z is a mole percent fraction ranging from about 1 to about 50%.

7. A method according to claim 1 wherein X is the polymerization residue of acrylamide, Y is the polymerization residue of 1,2-dihydroxypropyl methacrylate, Z is the polymerization residue of vinyl sulfonate and z is a mole percent fraction ranging from about 1 to about 50%.

8. A method according to claim 1 wherein X is the polymerization residue of acrylamide, Y is the polymerization residue of 1,2-dihydroxypropyl methacrylate, Z is the polymerization residue of vinyl phosphonate and z is a mole percent fraction ranging from about 1 to about 50%.

9. A method according to claim 1 wherein X is the polymerization residue of acrylamide, Y is the polymerization residue of hydroxyethyl methacrylate, Z is the polymerization residue of vinyl sulfonate and z is a mole percent fraction ranging from about 1 to about 50%.

10. A method according to claim 1 wherein X is the polymerization residue of acrylamide, Y is the polymerization residue of hydroxyethyl methacrylate, Z is the polymerization residue of vinyl phosphonate and z is a mole percent fraction ranging from about 1 to about 50%.

11. A method according to claim 1 wherein X is the polymerization residue of acrylamide, Y is the polymerization residue of 1,2-dihydroxypropyl methacrylate, Z is the polymerization residue of 2-acrylamido-2-methyl propane sulfonic acid and z is a mole percent fraction ranging from about 1 to about 50.

12. A method according to claim 1 wherein X is the polymerization residue of acrylamide, Y is the polymerization residue of hydroxyethyl methacrylate, Z is the polymerization residue of 2-acrylamido-2-methyl propane sulfonic acid and z is a mole percent fraction ranging from about 1 to about 50%.

13. A method according to claim 1 wherein X is the polymerization residue of acrylamide and t-butylacrylamide, Y is the polymerization residue of 1,2-dihydroxypropyl methacrylate and z is 0.

14. A method according to claim 1 wherein X is the polymerization residue of acrylamide, and methacrylamide, Y is the polymerization residue of 1,2-dihydroxypropyl methacrylate and z is 0.

15. A method according to claim 1 wherein X is the polymerization residue of acrylamide and methacrylamide, Y is the polymerization residue of hydroxyethyl methacrylate and z is 0.

16. A method according to claim 1 wherein Y represents a glyoxylated acrylamide unit and y is less than about 40.

17. A method according to claim 1 wherein X is the polymerization residue of acrylamide and t-butylacrylamide, Y is the polymerization residue of hydroxyethyl methacrylate and z is 0.

* * * * *